US006571758B2

(12) United States Patent
Tsukui et al.

(10) Patent No.: US 6,571,758 B2
(45) Date of Patent: Jun. 3, 2003

(54) FOUR-STROKE INTERNAL COMBUSTION ENGINE VALVE PAUSE MECHANISM

(75) Inventors: Takaaki Tsukui, Saitama (JP); Yoshiki Nagahashi, Saitama (JP); Kazuaki Iino, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/170,342

(22) Filed: Jun. 14, 2002

(65) Prior Publication Data

US 2003/0010301 A1 Jan. 16, 2003

(30) Foreign Application Priority Data

Jul. 16, 2001 (JP) ..... 2001-215688

(51) Int. Cl.[7] ..... F01L 1/34

(52) U.S. Cl. ..... 123/90.16; 123/90.48; 123/90.24; 123/90.26; 74/569

(58) Field of Search ..... 123/90.12, 90.15, 123/90.16, 90.17, 90.24, 90.26, 90.27, 90.31, 90.1, 90.48, 90.52, 90.38, 198 F, 90.6; 251/251; 74/569

(56) References Cited

U.S. PATENT DOCUMENTS

| | | | | |
|---|---|---|---|---|
| 4,770,137 A | * | 9/1988 | Okabe et al. | 123/198 F |
| 5,488,934 A | * | 2/1996 | Shirai et al. | 123/90.16 |
| 5,758,612 A | | 6/1998 | Tsuzuku et al. | 123/90.16 |
| 6,302,070 B1 | * | 10/2001 | Tsukui et al. | 123/90.16 |
| 6,386,163 B2 | * | 5/2002 | Tsukui et al. | 123/90.16 |

FOREIGN PATENT DOCUMENTS

| | | |
|---|---|---|
| DE | 199 41 367 A1 | 3/2000 |
| DE | 100 00 239 A1 | 7/2000 |
| EP | 1 020 619 A2 | 7/2000 |
| JP | 10184327 A | 7/1998 |

* cited by examiner

*Primary Examiner*—Thomas Denion
*Assistant Examiner*—Ching Chang
(74) *Attorney, Agent, or Firm*—Birch, Stewart, Kolasch & Birch, LLP

(57) ABSTRACT

A valve pause mechanism of a four-stroke internal combustion engine includes a valve pause mechanism. A valve lifter fitted between a valve cam and a valve stem of a poppet valve is always pressed in a direction in which the valve lifter contacts the valve cam with a lifter spring. However, a slide pin is fitted into a slide pin holder fitted in the valve lifter so that a slide pin can slide in a direction perpendicular to the valve stem. A stem working face in contact with the valve stem of the poppet valve and a stem through hole that the valve stem pierces are both adjacently formed in the slide pin and a slide pin driving mechanism. The slide pin driving mechanism selectively makes the stem working face and the stem through hole face the valve stem by moving the slide pin. A side of the slide pin at the back of the stem working face is chamfered across the stem through hole. A plane perpendicular to the central axis of the stem through hole is formed in a chamfered part and its both ends in a direction of the central axis of the slide pin continue to the peripheral surface of the slide pin in a smooth curve. The aforementioned arrangement provides a valve pause mechanism with a durable, relatively light slide pin.

15 Claims, 11 Drawing Sheets

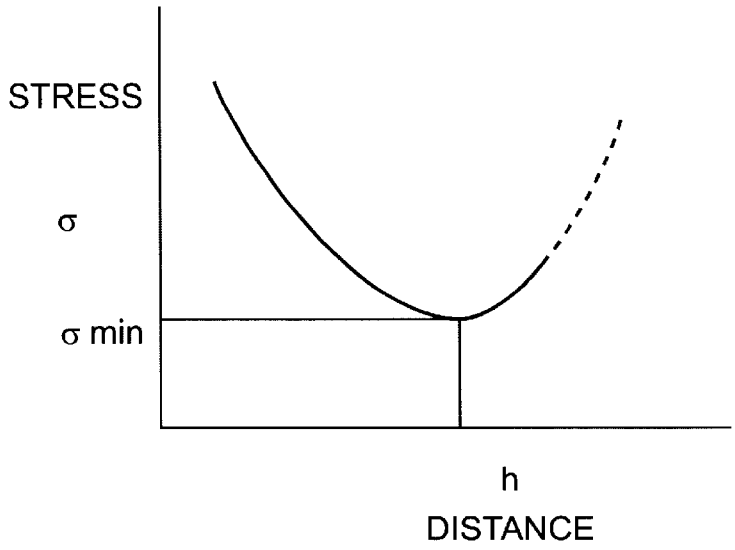
FIG. 13
FIG. 14
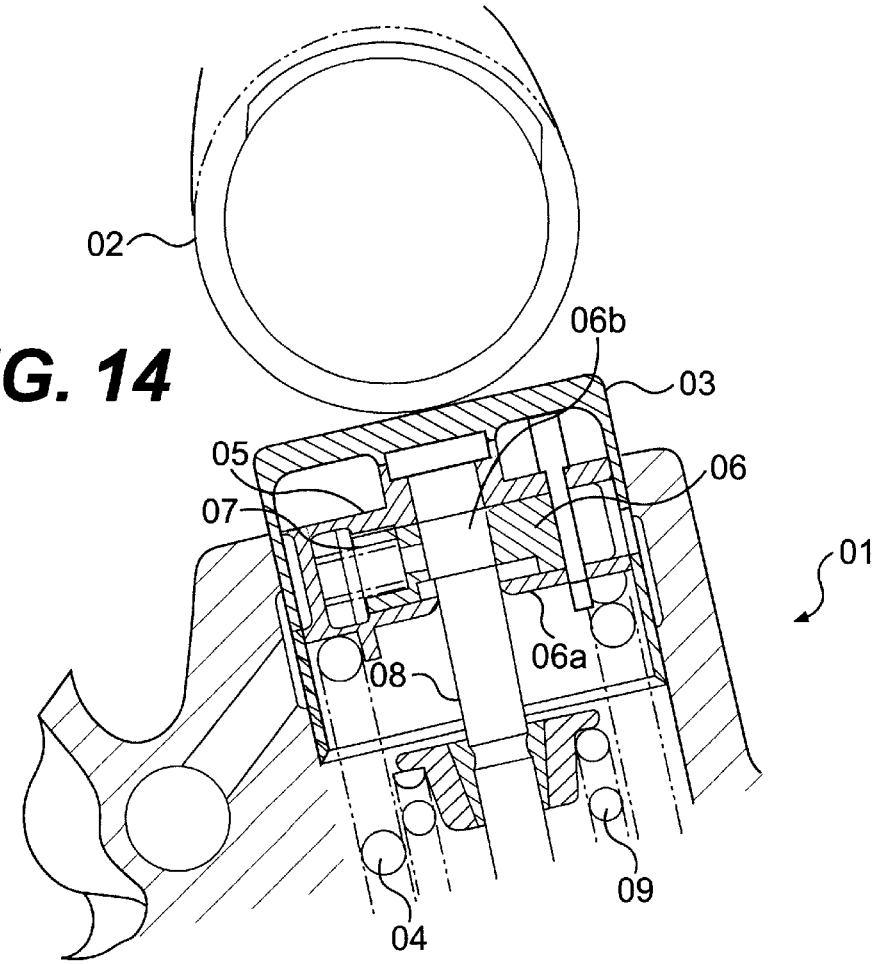

FOUR-STROKE INTERNAL COMBUSTION ENGINE VALVE PAUSE MECHANISM

BACKGROUND OF THE INVENTION

CROSS-REFERENCES TO RELATED APPLICATIONS

This nonprovisional application claims priority under 35 U.S.C. §119(a) on Patent Application No. 2001-215688 filed in Japan on Jul. 16, 2001, the entirety of which is herein incorporated by reference.

1. Field of the Invention

The present invention relates to a valve pause mechanism, and more particularly to a valve pause mechanism fitted between a valve lifter in reciprocating contact with a valve cam of a four-stroke internal combustion engine and a valve stem of a poppet valve.

2. Description of the Background Art

Japanese published unexamined patent application No. Hei 10-184327, the entirety of which is hereby incorporated by reference, describes an example of a valve pause mechanism of the background art.

As seen in FIGS. 14 to 16 of the present application, a valve lifter 03 fitted is into a cylinder head 01 of a four-stroke internal combustion engine so that the valve lifter 03 can slide in contact with a valve cam 02. The valve lifter 03 is also pressed by a lifter spring 04. A slide pin holder 05 is fitted into the valve lifter 03 and a slide pin 06 is inserted into the slide pin holder 05 so that the slide pin 06 can slide perpendicularly to a direction in which the valve lifter 03 is moved.

As shown in FIG. 15, the slide pin 06 is cylindrical. A stem working face 06*a* is formed by a part of the side of the slide pin 06 cut out flat. A stem through hole 06*b* is made perpendicularly to the central axis of the cylinder next to the stem working face 06*a*. The slide pin 06 pressed by a spring 07 is slid by oil pressure. A valve stem 08 is arranged so as to be pressed by a valve spring 09 so that the top end faces the stem working face 06*a*, or the stem through hole 06*b* respectively adjacent to the slide pin 06.

Therefore, where the slide pin 06 is located in a position in which the stem working face 06*a* faces the top end of the valve stem 08 (see FIG. 16), the valve stem 08 can be lowered via the slide pin 06. The valve can be opened or closed by lifting or lowering the valve stem 08 together with the valve lifter 03 lifted or lowered by the rotation of the valve cam 02.

When the slide pin 06 is moved and is located in a position in which the stem through hole 06*b* faces the top end of the valve stem 08 (a state shown in FIG. 14), the valve stem 08 is not untracked from the stem through hole 06*b* and cannot be lowered. Accordingly, the operation of the valve can be paused with the aforementioned arrangement.

The present inventors have determined that the inertial weight of a valve system increases by a quantity representative of the additional weight of the valve pause mechanism. A load of the valve spring is required to be increased corresponding to the increase in inertial weight and as a result, friction between the cam and the lifter increases.

As shown in FIG. 16, e.g., in the case of the slide pin 06 having the above-mentioned arrangement, the top end of the valve stem 08 is in contact with the stem working face 06*a* of the slide pin 06 in a valve operation state and a load is applied thereto. Stress is apt to concentrate on the deepest point P of an opening slightly within the stem through hole 06*b* at the back of the stem working face 06*a*.

Therefore, the present inventors have also determined that durability of the slide pin against the bending stress in the valve operation state should be considered based upon the dimensional relation between the outside diameter of the slide pin and the stem through hole, and the relation of a load from the valve spring.

SUMMARY OF THE INVENTION

The present invention overcomes the shortcomings associated with the background art and achieves other advantages not realized by the background art.

An object of the present invention is to provide a valve pause mechanism provided with a durable slide pin of lightweight.

One or more of the objects of the present invention is accomplished by a valve pause mechanism for a four-stroke internal combustion engine comprising a valve cam; a poppet valve having a valve stem; a lifter spring; a valve lifter fitted between the valve cam and the valve stem, wherein the poppet valve is always pressed in a direction in which the valve lifter remains in an operating contact position with the valve cam by the lifter spring; a slide pin holder being fitted within the valve lifter; a slide pin being fitted into the slide pin holder, the slide pin being capable of sliding in a reciprocating motion in a direction perpendicular to the valve stem and having an upper surface and a lower surface; a stem working face on the lower surface of the slide pin; a stem through hole adjacent to the stem working face; a slide pin driving mechanism, the slide pin driving mechanism selectively applying the stem working face and the stem through hole to the valve stem by sliding the slide pin in the reciprocating motion; a chamfered portion being formed along the upper surface of the slide pin and extending along a portion of the stem through hole.

One or more of the objects of the present invention is also accomplished by a slide pin holder assembly for a valve pause mechanism of a four-stroke internal combustion engine comprising a valve lifter having a valve lifter spring; a slide pin holder being fitted within the valve lifter; a cylindrical slide pin being fitted into the slide pin holder, the slide pin being capable of sliding in a reciprocating motion in a direction perpendicular to the valve stem and having an upper surface and a lower surface; a stem working face on the lower surface of the slide pin; a stem through hole adjacent to the stem working face; a chamfered portion being formed along the upper surface of the slide pin and extending along a portion of the stem through hole.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein:

FIG. 13 is a graphical view showing the variation of stress ó with respect to a distance h;

FIG. 14 is a sectional view showing an essential portion of a conventional valve pause mechanism of the background art;

DETAILED DESCRIPTION OF THE PREFERRED EMBODIMENTS

The present invention will hereinafter be described with reference to the accompanying drawings. Referring to FIGS. 1 to 13, one embodiment of the invention will be described hereinafter.

Figure 1:
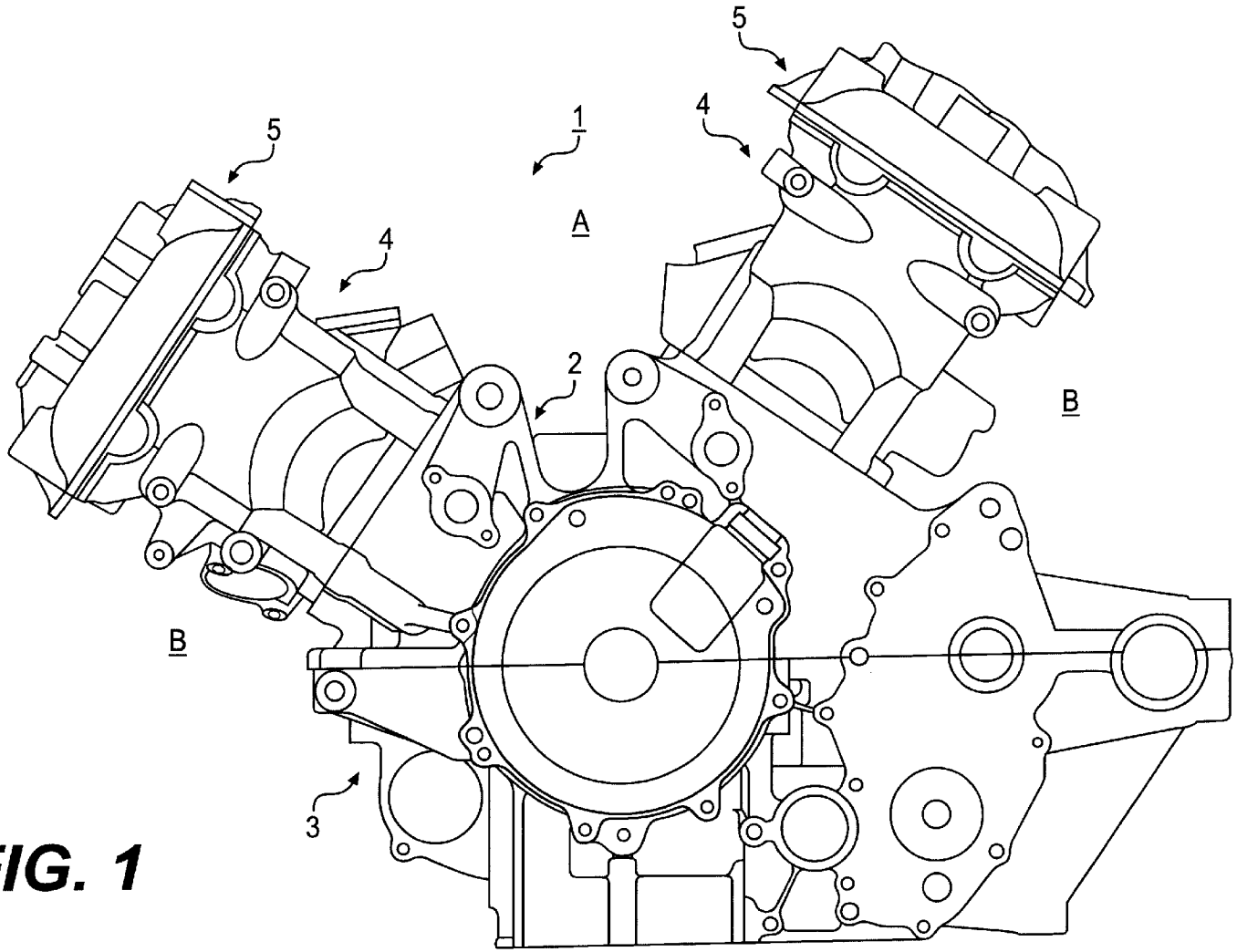
FIG. 1 is a side view showing a four-stroke internal combustion engine with a valve pause mechanism according to an embodiment of the present invention.
Figure 2:
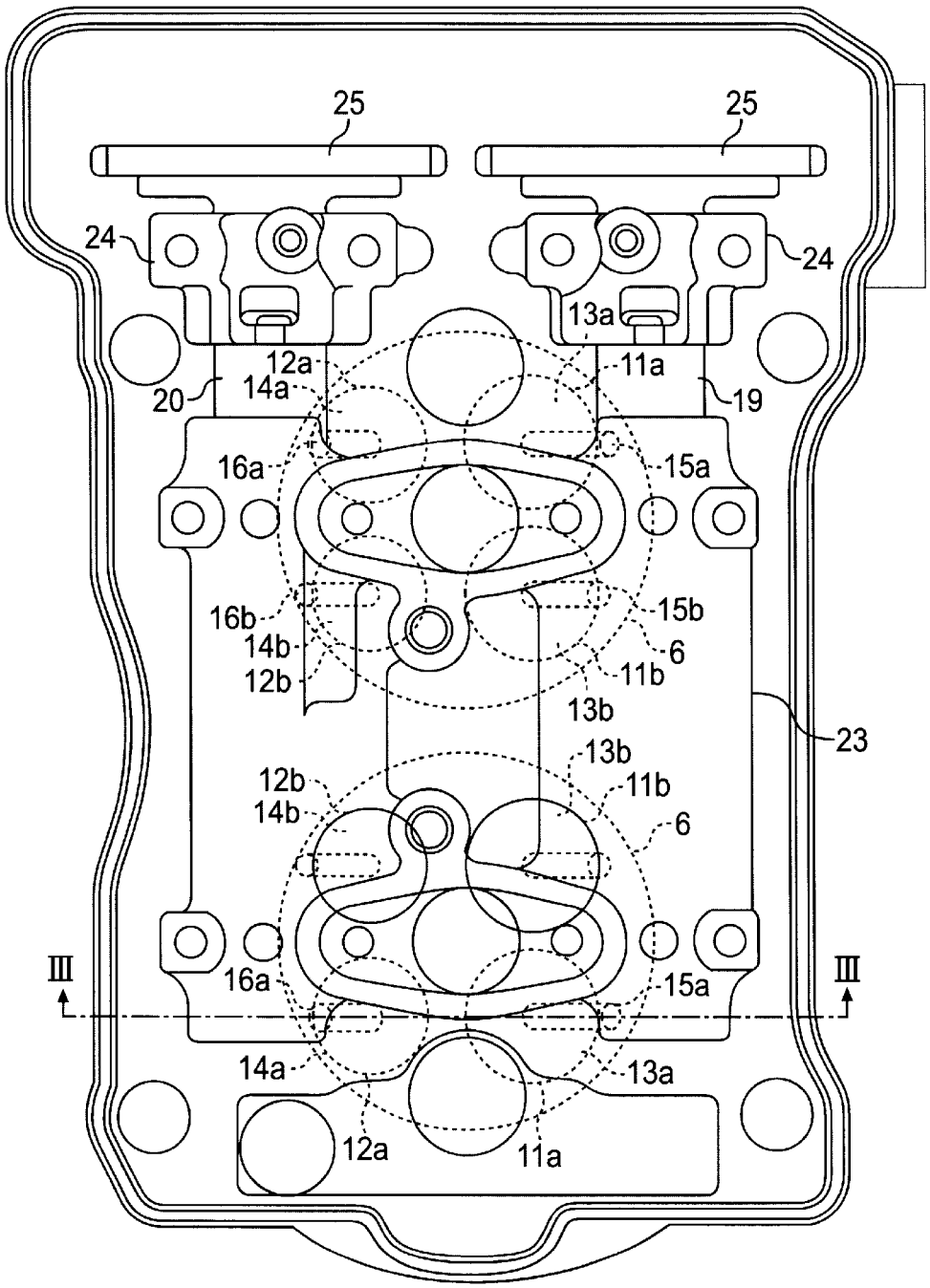
FIG. 2 is a top view showing a front cylinder head from which a front head cover is detached according to the present invention.
Figure 3:
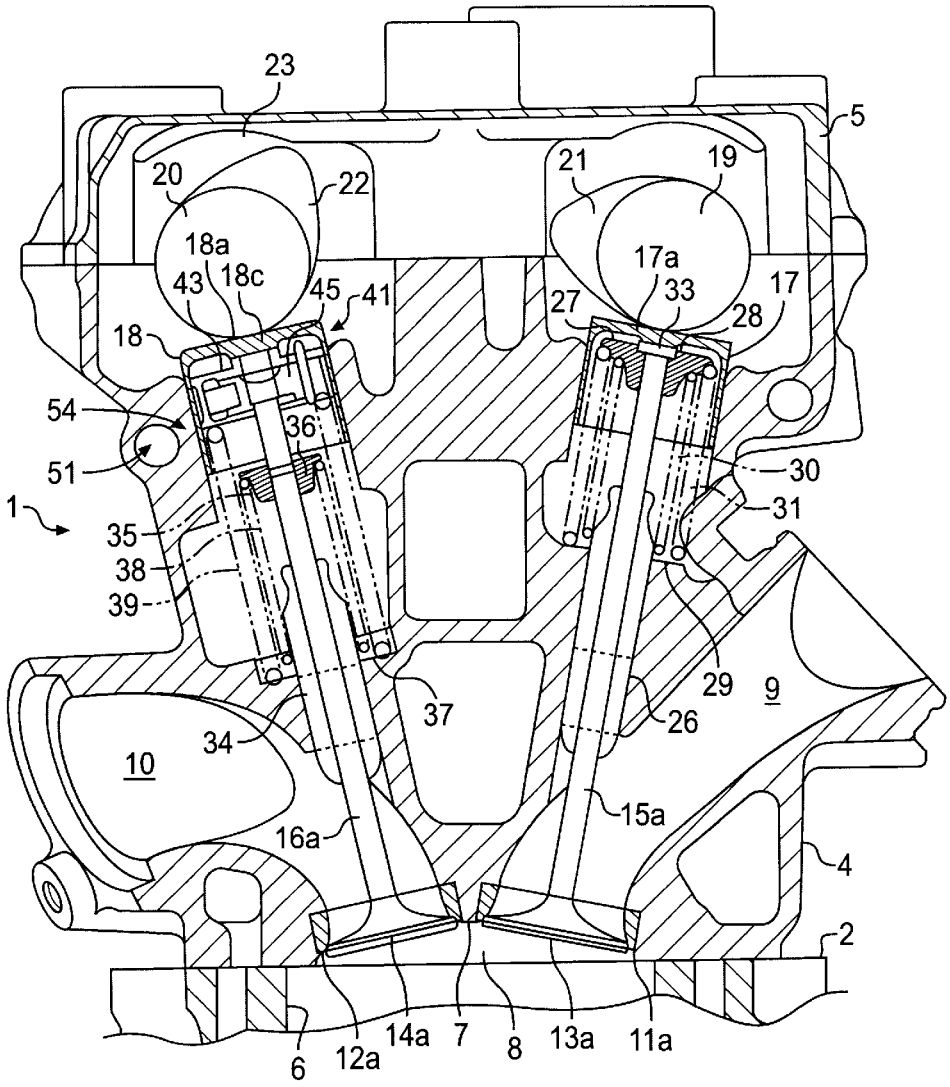
FIG. 3 is a sectional view viewed along a line III—III in FIG. 2.
Figure 4:
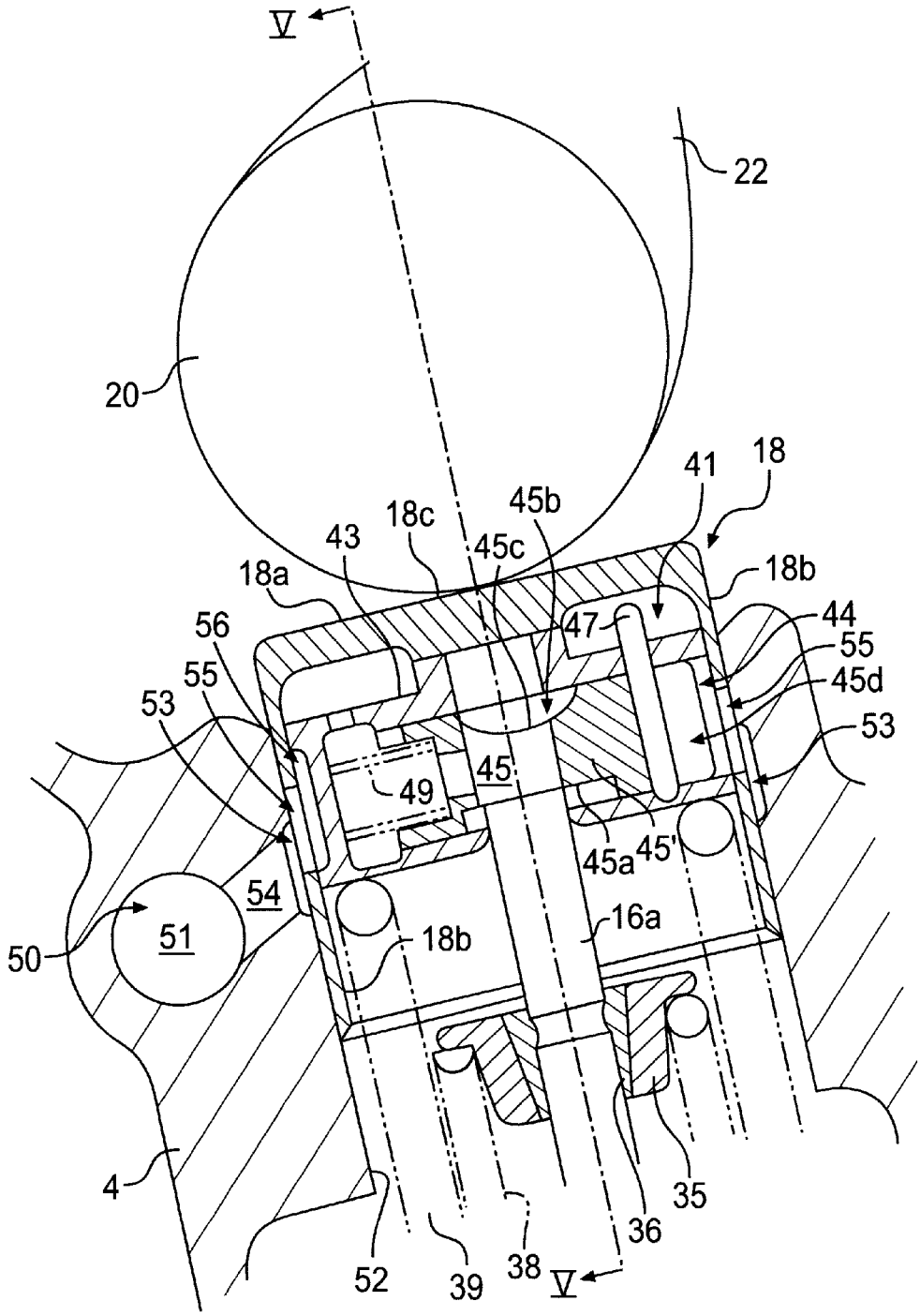
FIG. 4 is an enlarged sectional view showing a part shown in FIG. 3 in a valve paused state.
Figure 5:
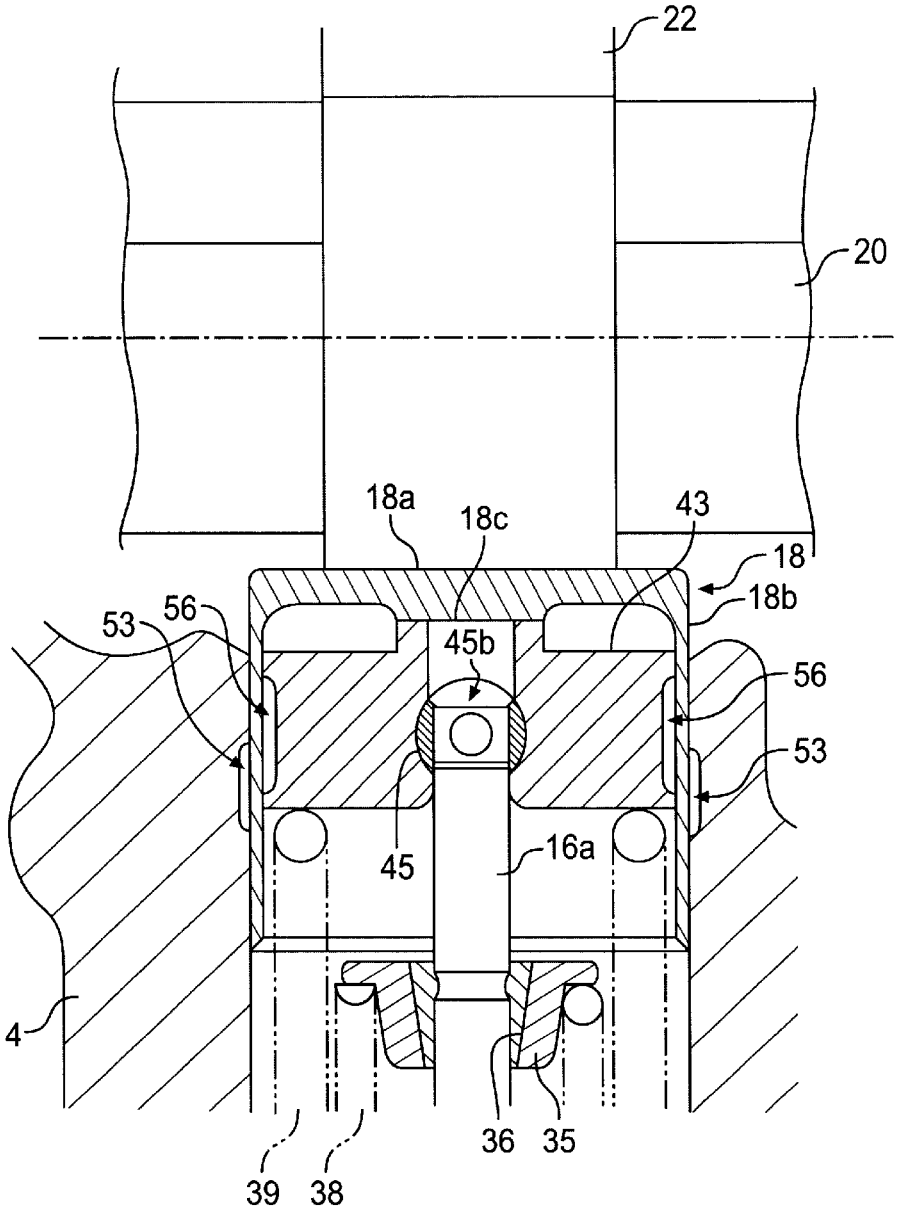
FIG. 5 is a sectional view viewed along a line V—V in FIG. 4.
Figure 6:
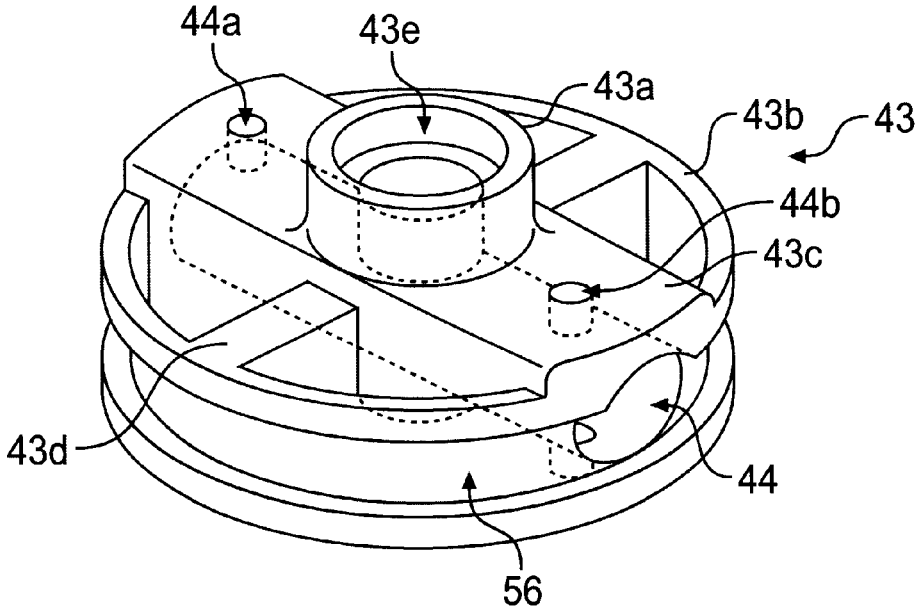
FIG. 6 is a perspective view showing a slide pin holder according to the present invention.
Figure 7:
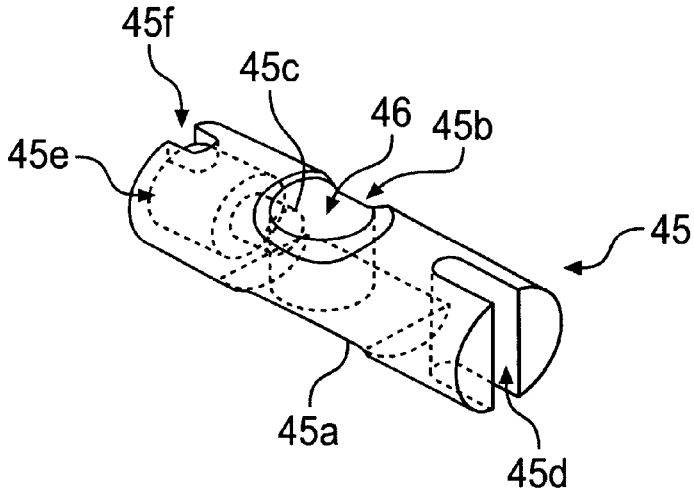
FIG. 7 is a perspective view showing a slide pin according to the present invention.
Figure 8:
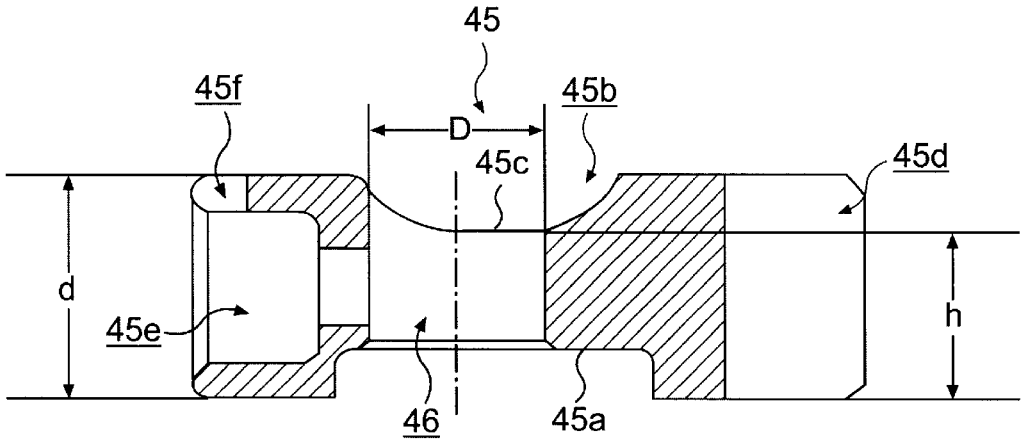
FIG. 8 is a sectional view showing the slide pin of FIG. 7.
Figure 9:
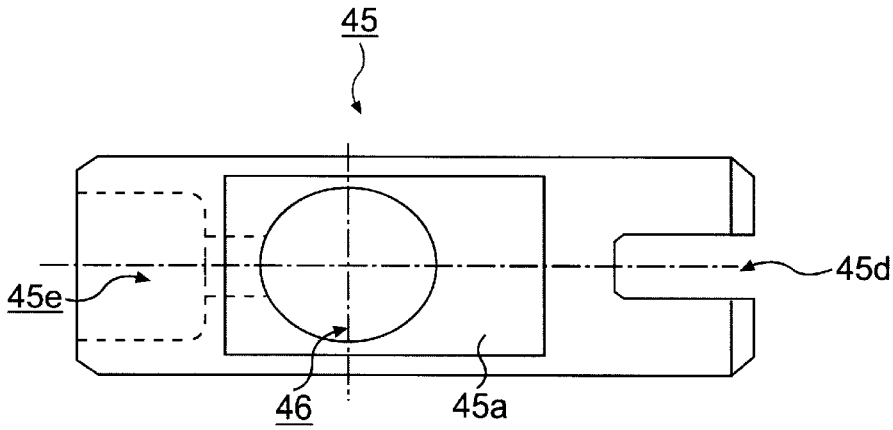
FIG. 9 is a bottom view showing the slide pin of FIG. 7.
Figure 10:
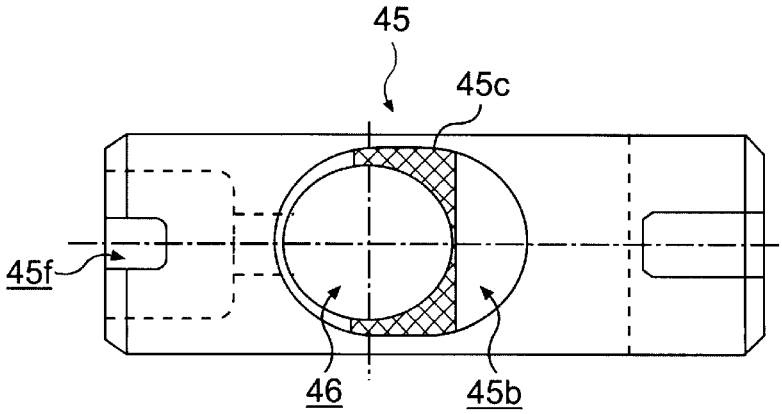
FIG. 10 is a top view showing the slide pin of FIG. 7.
Figure 11:
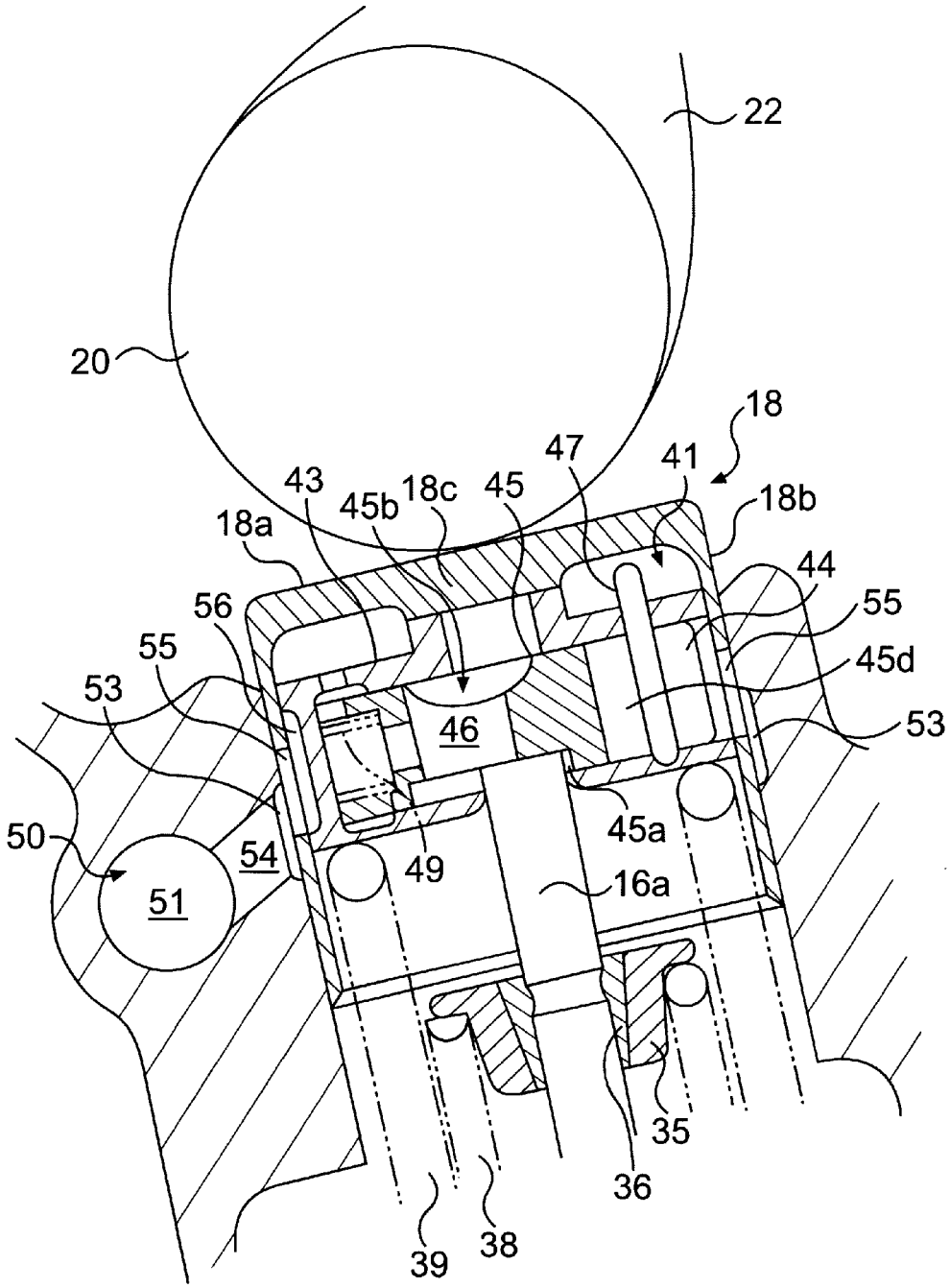
FIG. 11 is an enlarged sectional view showing a part shown in FIG. 3 in which the valve is not in a paused state.
Figure 12:
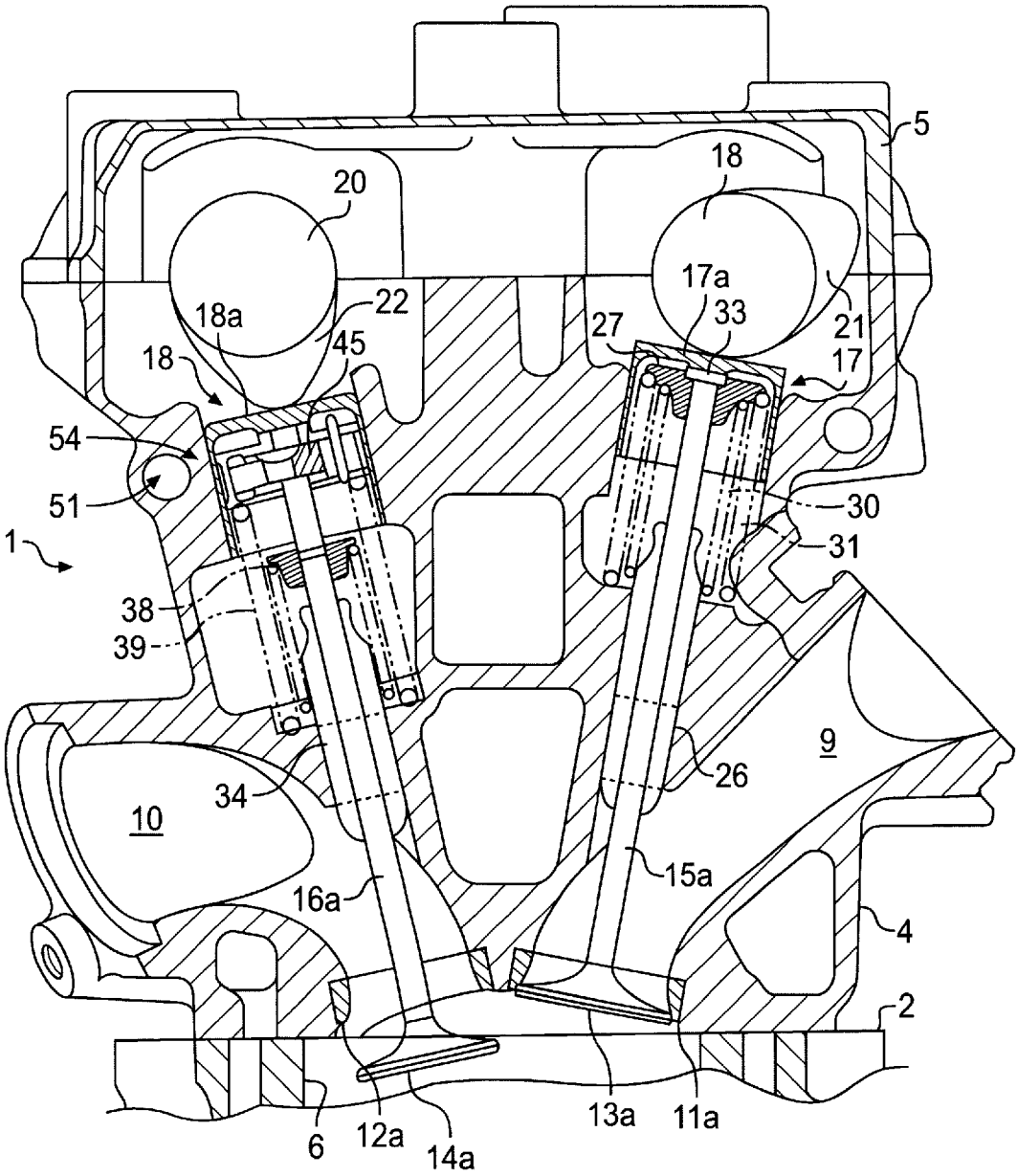
FIG. 12 is a sectional view showing a state in which the valve is not paused and an exhaust valve is opened by a cam.
Figure 15:
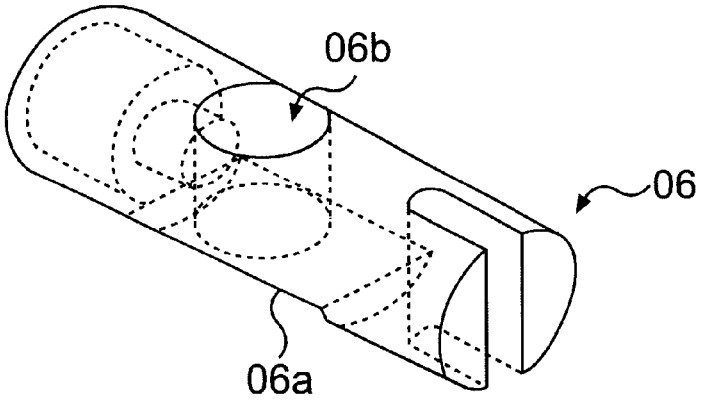
FIG. 15 is a perspective view showing a slide pin used in the valve pause mechanism of the background art.

FIG. 1 is a side view showing a four-stroke internal combustion engine with a valve pause mechanism according to an embodiment of the present invention. FIG. 2 is a top view showing a front cylinder head from which a front head cover is detached according to the present invention. FIG. 3 is a sectional view viewed along a line III—III in FIG. 2. FIG. 4 is an enlarged sectional view showing a part shown in FIG. 3 in a valve paused state. FIG. 5 is a sectional view viewed along a line V—V in FIG. 4. FIG. 6 is a perspective view showing a slide pin holder according to the present invention. FIG. 7 is a perspective view showing a slide pin according to the present invention. FIG. 8 is a sectional view showing the slide pin of FIG. 7. FIG. 9 is a bottom view showing the slide pin of FIG. 7. FIG. 10 is a top view showing the slide pin of FIG. 7. FIG. 11 is an enlarged sectional view showing a part shown in FIG. 3 in which the valve is not in a paused state. FIG. 12 is a sectional view showing a state in which the valve is not paused and an exhaust valve is opened by a cam. FIG. 13 is a graphical view showing the variation of stress ó with respect to a distance h.

An OHC four-stroke internal combustion engine 1 mounted in a motorcycle (not shown) is a fore and aft V-type internal combustion engine in which a crankshaft (not shown) is directed in a direction of the width of the vehicle body. A cylinder on the front side of the vehicle body and a cylinder on the rear side of the vehicle body make a right included angle as shown in FIG. 1. The body of the OHC four-stroke internal combustion engine 1 includes a cylinder block 2, a crankcase 3 integrated with the cylinder block 2 on the lower surface of the cylinder block 2, two pairs of cylinder heads 4 integrated with the head end of a cylinder bank on the front side of the vehicle body and a cylinder bank on the rear side of the vehicle body in the cylinder block 2, respectively. Two pairs of head covers 5 respectively cover the heads of the cylinder heads 4.

The cylinder blocks 2 are installed on the front side of the vehicle body and on the rear side of the vehicle body. In each cylinder block 2 two cylinder bores 6 are arranged in the direction of the body width as shown in FIG. 2 (only the cylinder block on the front side of the vehicle body out of the cylinder blocks on the front side and the rear side is shown), thereby forming a four-cylinder OHC four-stroke internal combustion engine 1. A pent roof type concave portion 7 is respectively formed in a location corresponding to the cylinder bore 6 on the lower surface of each cylinder head 4 located on the front side and on the rear side of the vehicle body as shown in FIG. 3. A combustion chamber 8 is formed by the cylinder bore 6, the concave portion 7 and a piston (not shown) fitted into the cylinder bore 6.

Further, in each cylinder bank of the V-type four-cylinder OHC four-stroke internal combustion engine 1, an intake system (not shown) including a carburetor and an intake chamber is arranged on the side of a cylinder included angle (on the side in contact with the V-shaped fore and after space A shown in FIG. 1, e.g., the space between the cylinder bank on the front side of the vehicle body and the cylinder bank on the rear side of the vehicle body). An exhaust pipe (not shown) is connected outside each cylinder bank on the front side and on the rear side of the vehicle body (the outside B of the fore and after V-type space A).

Further, as shown in FIG. 3, on the rear side of the cylinder head 4 on the front side of the vehicle body, one intake passage on the upstream side connected to the intake system is branched into two intake passages on the downstream side of the intake. An inlet port 9 open to the combustion chamber 8 in two locations is formed on the front side of the cylinder head 4 on the front side of the vehicle body. Two exhaust passages on the upstream side open to the combustion chamber 8 in two locations are integrated in one exhaust passage on the downstream side of the exhaust. An exhaust port 10 is formed and connected to the exhaust pipe (not shown).

As shown in FIG. 2, intake poppet valves 13*a* and 13*b* and exhaust poppet valves 14*a* and 14*b* that respectively seal two inlet openings 11*a* and 11*b* and two exhaust openings 12*a* and 12*b* so that the valves can be opened or closed are provided in the cylinder head 4. An inlet port and an exhaust port (reversed in fore and after positions with respect to the inlet port 9 and the exhaust port 10 in the cylinder head 4 on the front side of the vehicle body) are also formed in the cylinder head 4 on the rear side of the vehicle body.

Furthermore, as shown in FIG. 2, the intake poppet valve 13*a* is provided in the inlet opening 1 a located on the outside of the vehicle body in each cylinder bore 6. The intake poppet valve 13*a* is opened or closed with a valve lifter 17 (without a valve pause mechanism shown in FIG. 3) The opening or closing of the exhaust poppet valve 14*a* can be paused by a valve lifter 18 having the valve pause mechanism shown in FIG. 3 attached. The exhaust poppet valve 14*a* is provided in the exhaust opening 12*a* located on the outside of the vehicle body in each cylinder bore 6.

The intake poppet valve 13*b* to which the valve lifter 18 with the valve pause mechanism is attached is provided in the inlet opening 11*b* located on the inside of the vehicle body in each cylinder bore 6, e.g., opposite to the inlet opening 11*a* on the outside of the vehicle body. A valve lifter 17 without the valve pause mechanism is attached to the exhaust opening 12*b* located on the inside of the vehicle body in each cylinder bore 6, e.g., opposite to the exhaust opening 12*a* on the outside of the vehicle body (not shown in the longitudinal sectional view).

Only the intake poppet valve 13*a* provided in the inlet opening 11*a* on the outside of the vehicle body in the cylinder head 4 on the front side of the vehicle body, e.g., provided with the valve lifter 17 without the valve pause mechanism, and the exhaust poppet valve 14*a* provided in the exhaust opening 12*a* and with the valve lifter 18 having the valve pause mechanism will be described hereinafter.

An inlet camshaft 19 is arranged over an extension of a valve stem 15*a* of the intake poppet valve 13*a*. An exhaust camshaft 20 is arranged over an extension of a valve stem 16*a* of the exhaust poppet valve 14*a*. The inlet camshaft 19 and the exhaust camshaft 20 are attached to the cylinder head 4 respectively by a camshaft holder 23 located in the center and a camshaft holder 24 located on the right side in the direction of the body width, respectively, so that the respective camshafts can be rotated as shown in FIG. 2.

An inlet cam 21 of the inlet camshaft 19 and an exhaust cam 22 of the exhaust camshaft 20 in every cylinder bore 6 are touched to each top face of the valve lifter 17*a* without the valve pause mechanism of the intake poppet valve 13*a* and the valve lifter 18*a* with the valve pause mechanism of the exhaust poppet valve 14*a*. Driven sprockets 25, 25 are respectively integrated with the inlet camshaft 19 and the exhaust camshaft 20 at the right end of the vehicle body. An endless chain (not shown) is laid between a drive sprocket (not shown) integrated with a crankshaft (not shown) and the driven sprockets 25, 25. When the OHC four-stroke internal combustion engine 1 is operated, the inlet cam 21 and the exhaust cam 22 are rotated at a speed equivalent to a half of the rotational speed of the crankshaft and in the same direction.

In the intake poppet valve 13*a* to which the valve lifter 17 without the valve pause mechanism is attached, a valve guide cylinder 26 for guiding and supporting the valve stem 15*a* of the intake poppet valve 13*a* is formed. Accordingly, the stem is formed longer by the quantity without the valve pause mechanism to compensate for the reduced length of the valve pause mechanism.

A retainer 27 is fitted to the top of the valve stem 15*a* of the intake poppet valve 13*a*. The retainer 27 is integrated with the top end of the valve stem 15*a* by a cotter 28. Two inside and outside valve springs 30, 31 are fitted in parallel between a valve spring retainer 29 in the vicinity of an upper part of the valve guide cylinder 26 and the retainer 27 in parallel and the intake poppet valve 13*a* is always pressed in a direction in which the opening 11*a* of the inlet port 9 is sealed by the spring of the valve springs 30, 31.

A shim 33 is fitted between the top end of the valve stem 15*a* of the intake poppet valve 13*a* and the top wall 17*a* of the valve lifter 17 in a central hole of the retainer 27. The top wall 17*a* of the valve lifter 17 without the valve pause mechanism is pressed in a direction in which the top wall is touched to the inlet cam 21 by the spring force of the valve springs 30, 31.

In the exhaust poppet valve 14*a* to which the valve lifter 18 with the valve pause mechanism is attached, a valve guide cylinder 34 for guiding and supporting the valve stem 16*a* of the exhaust poppet valve 14*a* so that the valve stem can be slid is formed shorter by a length corresponding to the length of the valve pause mechanism. A retainer 35 is fitted on an upper part in place of the top end of the valve stem 16*a* of the exhaust poppet valve 14*a*. The retainer 35 is integrated with the upper part of the valve stem 16*a* by a cotter 36. A valve spring 38 is fitted between a spring retainer 37 in the vicinity of the upper part of the valve guide cylinder 34 and the retainer 35.

A lifter spring 39 having a larger diameter than the diameter of the valve spring 38 is fitted between the spring retainer 37 and the valve lifter 18*a* with the valve pause mechanism. Therefore, the exhaust poppet valve 14*a* is always pressed in a direction in which the exhaust opening 12*a* of the exhaust port 10 is sealed by the spring of the valve spring 38. The top wall 18*a* of the valve lifter 18 is pressed in a direction in which the top wall is touched to the exhaust cam 22 by the spring of the lifter spring 39.

In the center of the top wall 18*a* of the valve lifter 18 with the valve pause mechanism, a thick part 57 slightly thicker than the peripheral part for functioning as a shim is formed. A thick shim 18*c* is formed in various thickness and a few types of valve lifters with the valve pause mechanism are easily prepared as necessary by the individual application.

The valve pause mechanism 41 in the valve lifter 18 will be described hereinafter. As shown in FIGS. 4 and 5, the cylindrical peripheral wall 18*b* of the valve lifter 18 with the valve pause mechanism is guided into a lifter guide hole 52 provided in the cylinder head 4. The cylindrical peripheral wall 18*b* can be vertically slid and adjusted. A slide pin holder 43 is fitted in the valve lifter 18 with the valve pause mechanism.

For the slide pin holder 43, as shown in FIG. 6, a central cylindrical part 43*a* and a peripheral circular part 43*b* are coupled via cross members 43*c* , 43*d*. A circular hole of the cylindrical part 43*a* functions as a stem guide hole 43*e*. A peripheral concave groove 56 is formed on the peripheral surface of the circular part 43*b*. A slide pin hole 44 is formed in the cross member 43*c* directed in one direction of the diameter in a state in which one end is closed. A through hole 44*a* is provided near to the closed end of the slide pin hole 44 and a guide pin hole 44*b* is open to the open, opposite end.

The circular part 43*b* of the slide pin holder 43 is inserted along the cylindrical peripheral wall 18*b* of the valve lifter 18 with the valve pause mechanism and the upper end of the cylindrical part 43*a* is in contact with the shim 18*c*. The slide pin 45 is fitted into the slide pin hole 44 of the slide pin holder 43 so that the slide pin can be slid within the hole 44.

The slide pin 45 is cylindrical as shown in FIGS. 7 to 10. A part of the side is cut out flat to form a stem working face 45*a*. A stem through hole 46 is made perpendicularly to the stem working face 45*a* and the central axis of the cylindrical pin next to the stem working face 45*a*.

The side at the back of the stem working face 45*a* of the slide pin 45 is chamfered across the stem through hole 46 to form a chamfered portion 45*b*. A plane 45*c* (a part parallel to the stem working face 45*a* and shown by a grid-like hatch in FIG. 10) perpendicular to the central axis of the stem through hole 46 is formed within the chamfered portion 45*b*. Both ends of the plane 45*c* in a direction of the central axis of the slide pin extend toward the peripheral surface of the slide pin 45 in a smooth curve.

A guide groove 45*d* is formed extending in a radial direction at one end of the slide pin 45. A spring guide hole 45*e* is provided to the other end, and a part of an opening edge of the spring guide hole 45*e* is cut out and a vent groove 45*f* is formed. Where a ratio d/D of the outside diameter of the cylindrical slide pin 45*d* to the inside diameter of the stem through hole 46 D (as shown in FIG. 8) is preferably set in a range of 1.36 to 1.40, the present inventors have determined that structural integrity and strength is maximized while still providing a relatively light slide pin.

A distance, e.g., a distance acquired by subtracting the depth of the chamfered part 45*b* up to the plane 45*c* from the outside diameter d, from the plane 45*c* of the chamfered part 45*b* to the side at the back of the slide pin 45 is indicated as "h" in FIG. 8. When the ratio d/D is in a range of 1.36 to 1.40, the ratio h/d of the distance h to the outside diameter d of the slide pin 45 is preferably designed so that it is in the range of 0.73 to 0.82.

A pin spring 49 is inserted into the spring guide hole 45*e* of the slide pin 45. The slide pin is inserted into the slide pin hole 44 of the slide pin holder 43 from a part including the pin spring 49. A guide pin 47 is fitted into the guide pin hole 44*b*. and the guide groove 45*d* of the slide pin 45 is pierced. The position of the slide pin 45 is regulated and the movement of the slide pin 45 controlled by a spring force from the pin spring 49 regulated by the guide pin 47.

The slide pin holder 43, into which the slide pin 45 is inserted as described above, is inserted into the valve lifter 18 with the valve pause mechanism. When the valve lifter 18 with the valve pause mechanism is inserted into the lifter guide hole 52, the top end of the valve stem 16*a* of the exhaust poppet valve 14 is guided by a lower part of the stem guide hole 43*e* of the slide pin holder 43. The top end of the valve stem 16*a* is opposed to the stem through hole 46 or the stem working face 45*a*, e.g., as seen in FIG. 4.

The upper end of the lifter spring 39 is in contact with the slide pin holder 43 and presses the valve lifter 18 with the valve pause mechanism upward via the slide pin holder 43. The valve lifter is accordingly brought into contact with to the exhaust cam 22. Plural side holes 55 communicating with the peripheral concave groove 56 of the slide pin holder 43, regardless of the position of the valve lifter 18*a* of the valve pause mechanism, are made on the cylindrical peripheral wall 18*b* of the valve lifter 18. An inside concave groove 53 communicating with the side hole 55 is formed in the lifter guide hole 52 of the cylinder head 4. The inside concave groove 53 communicates with a pressure oil passage 51 of the cylinder head 4 via a connecting hole 54.

The pressure oil passage 51 is connected to a discharge port of a hydraulic pump (not shown) provided in the OHC four-stroke internal combustion engine 1 via a control valve (not shown). Pressurized oil is led to the opening of the slide pin hole 44 of the slide pin holder 43 from the pressure oil passage 51 through the connecting hole 54, the inside concave groove 53, the side hole 55 and the peripheral concave groove 56 by a hydraulic drive unit 50 described above. This flow of pressurized oil permits the slide pin 45 to be slid against the pin spring 49.

In a state where the OHC four-stroke internal combustion engine 1 is operated at low speed or a low load, and very little or no pressure oil is supplied to the pressure oil passage 51, the pressurized oil is not led to the slide pin hole 44. The slide pin 45 is pressed and moved by the spring of the pin spring 49 and as shown in FIGS. 4 and 5, the bottom of the guide groove 45*d* is fitted to the guide pin 47 with the stem through hole 46 located over the valve stem 16*a*, e.g., the valve stem 16*a* is aligned in a position that allows extension through the slide pin and in contact with the valve lifter 18.

In the above-mentioned low-speed or low-load operation, the top of the valve stem 16*a* (15*b* ) of the exhaust poppet valve 14*a* (and the intake poppet valve 13*b* ) pierces the stem through hole 46 of the slide pin 45. Accordingly, slide pin 45 can be relatively freely slid, and the exhaust poppet valve 14*a* (the intake poppet valve 13*b*) is held in a closed state even if the valve lifter 18 with the valve pause mechanism is vertically lifted or lowered by the exhaust cam 22 (the inlet cam 21). Therefore, despite the normal operation of the exhaust cam and the engagement with the valve lifter 18, the exhaust poppet valve 14*a* remains in a valve paused state.

Alternatively, when the OHC four-stroke internal combustion engine 1 is operated at low speed or at a low load and pressure oil is supplied to the pressure oil passage 51, pressure oil is led from the pressure oil passage 51 into the slide pin hole 44 via the connecting hole 54, the inside concave groove 53, the side hole 55 and the peripheral concave groove 56. The slide pin 45 is moved against the spring force of the pin spring 49 by the flow of pressurized oil at the entrance of the slide pin hole 44. As shown in FIGS. 11 and 12, when the top end of the valve stem 16*a* (15*b*) of the exhaust poppet valve 14*a* (the intake poppet valve 13*b*) is opposite to the stem working face 45*a* of the slide pin 45 and the valve lifter 18 with the valve pause mechanism is lifted or lowered by the exhaust cam 22 (the inlet cam 21), the exhaust poppet valve 14*a* (the intake popper valve 13*b*) is opened or closed via the slide pin 45 as shown in FIGS. 11 and 12.

Since the slide pin 45 is lightened owing to the chamfered part 45*b*, the equivalent weight of the exhaust poppet valve 14*a* (the intake poppet valve 13*b*) decreases in the valve lifter 18 having the aforementioned valve pause mechanism. Accordingly, the load of the lifter spring 39 and the valve spring 38 is reduced and power loss for opening or closing of the applicable valves, e.g., intake poppet valve 13*b* and exhaust poppet valve 14*a*, is reduced.

The ratio d/D of the outside diameter d of the slide pin 45 to the inside diameter D of the stem through hole 46 is set to a range of 1.36 to 1.40 to maintain and maximize structural integrity while still providing an advantageously lightweight slide pin 45.

As a plane 45*c* perpendicular to the central axis of the stem through hole 46 is formed in the chamfered part 45*b* as shown by a grid-like hatch in FIG. 10 and its both ends in a direction of the central axis of the slide pin continue to the peripheral surface of the slide pin in a smooth curve, stress generated in the opening of the stem through hole 46 at the back does not concentrate on one point when the top end of the valve stem 16*a* is touched to the stem working face 45*a* of the slide pin 45 and presses it, is diffused on the chamfered plane 45*c* and the durability is greatly increased.

Further, maximum stress generated in the slide pin can be minimized by pressure that the slide pin receives from the valve stem in a valve-operated state. Specifically, by setting the ratio hid of distance h from the plane 45*c* of the chamfered part 45*b* to the side at the back to the outside diameter d of the slide pin to approximately 0.73 to 0.82, the maximum stress generated is desirably minimized in the slide pin 45. A value of the ratio h/d is acquired based upon the result of the measurement of the variation of stress ó when the outside diameter d of the slide pin 45 is fixed and distance h is varied. FIG. 13 is a graphical view showing the variation of the stress ó with respect to the distance h of the aforementioned slide pin 45 configurations.

Figure 16:
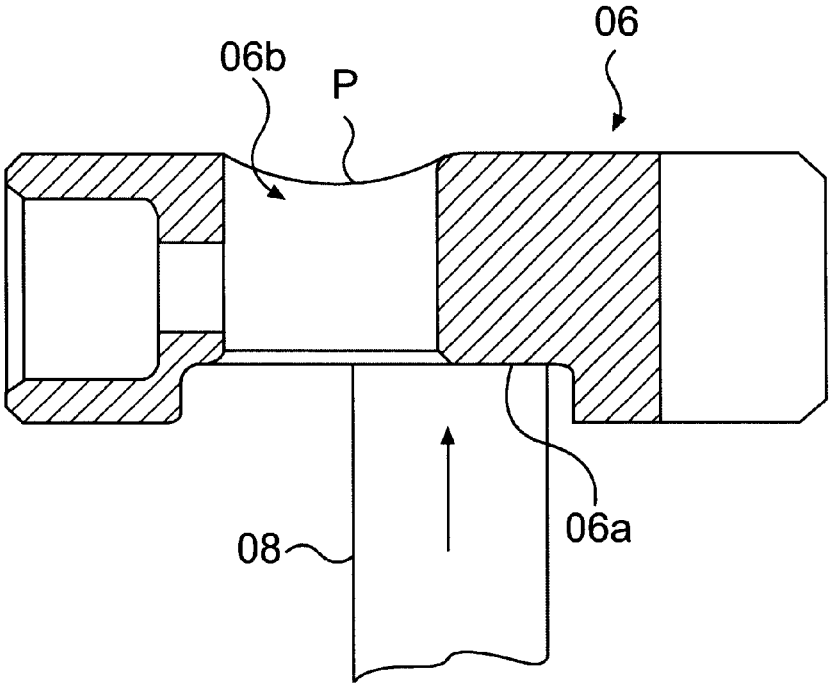
FIG. 16 is a sectional view showing a state in which the slide pin and a valve stem are in contact in the valve pause mechanism of the background art.

The present inventors have determined that when the distance h is small, e.g., the chamfered part is relatively deep chamfered, the thickness of the stem through hole 46 decreases, the flexural rigidity is deteriorated and stress is undesirably increased. Conversely, when the distance h is large, the slide pin is close to a conventional, unchamfered slide pin of the background art, and stress is apt to concentrate on the deepest part in the opening of the stem through hole 46 (see a point P shown in FIG. 16) and stress is undesirably increased as well.

Therefore, as shown in FIG. 13, the variation of stress forms a convex curve downward. The curve has the minimum value $\acute{o}_{min}$ of stress $\acute{o}$ at a lowpoint of the curve. It is determined from these experimental results that the ratio h/d in a range of 0.73 to 0.82 provides the minimum value $\acute{o}_{min}$.

In low-speed or low-load operation, the exhaust poppet valve 14*a* and the intake poppet valve 13*b* are respectively paused by the valve lifters 18*a* and 18*b* with the aforementioned valve pause mechanisms. When the intake poppet valve 13*a* and the exhaust poppet valve 14*b*, respectively always opened or closed, are diagonally located as shown in FIG. 2, a swirl is generated in an air-fuel mixture in the combustion chamber 8. Accordingly, ignition is executed securely and reliably and the partial or incomplete combustion is prevented and fuel economy is improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve pause mechanism for a four-stroke internal combustion engine comprising:

a valve cam;

a poppet valve having a valve stem;

a lifter spring;

a valve lifter fitted between the valve cam and the valve stem, wherein said poppet valve is always pressed in a direction in which the valve lifter remains in an operating contact position with the valve cam by the lifter spring;

a slide pin holder being fitted within the valve lifter;

a slide pin being fitted into the slide pin holder, said slide pin being capable of sliding in a reciprocating motion in a direction perpendicular to the valve stem and having an upper surface and a lower surface;

a stem working face on the lower surface of said slide pin;

a stem through hole adjacent to said stem working face;

a slide pin driving mechanism, said slide pin driving mechanism selectively applying the stem working face and the stem through hole to the valve stem by sliding the slide pin in said reciprocating motion;

a chamfered portion being formed along said upper surface of said slide pin and extending along a portion of the stem through hole.

2. The valve pause mechanism according to claim 1, wherein a ratio d/D of an outside diameter (d) of the slide pin to an inside diameter (D) of the stem through hole is approximately 1.36 to 1.40.

3. The valve pause mechanism according to claim 1, wherein a ratio (h/d) of a distance h from a plane extending through said chamfered portion along the upper surface of the slide pin to an outside diameter (d) of the slide pin is approximately 0.73 to 0.82.

4. The valve pause mechanism according to claim 2, wherein a ratio (h/d) of a distance h from a plane extending through said chamfered portion along the upper surface of the slide pin to the outside diameter (d) of the slide pin is approximately 0.73 to 0.82.

5. The valve pause mechanism according to claim 1, said slide pin holder further including a central cylindrical portion and a peripheral circular portion being coupled via a pair of cross members.

6. The valve pause mechanism according to claim 5, said slide pin holder further including a circular hole within the cylindrical part and axially aligned with at least said valve stem.

7. The valve pause mechanism according to claim 5, said slide pin holder further including a peripheral concave groove being formed on the peripheral circular portion, and a slide pin hole formed within at least one of said cross members.

8. The valve pause mechanism according to claim 7, wherein said slide pin hole includes a closed end and an opened end, a through hole being provided adjacent to the closed end and a guide pin hole opening to the opened end.

9. The valve pause mechanism according to claim 6, said slide pin holder further including a peripheral concave groove being formed on the peripheral circular portion, and a slide pin hole formed within at least one of said cross members.

10. The valve pause mechanism according to claim 9, wherein said slide pin hole includes a closed end and an opened end, a through hole being provided adjacent to the closed end and a guide pin hole opening to the opened end.

11. The valve pause mechanism according to claim 1, said slide pin further comprising a guide groove being formed extending in a radial direction at a first end of the slide pin, a spring guide hole being provided on an opposite end, and a portion of an opening edge of the spring guide hole having a vent groove.

12. A slide pin holder assembly for a valve pause mechanism of a four-stroke internal combustion engine comprising:

a valve lifter having a valve lifter spring;

a slide pin holder being fitted within the valve lifter;

a cylindrical slide pin being fitted into the slide pin holder, said slide pin being capable of sliding in a reciprocating motion in a direction perpendicular to the valve stem and having an upper surface and a lower surface;

a stem working face on the lower surface of said slide pin;

a stem through hole adjacent to said stem working face;

a chamfered portion being formed along said upper surface of said slide pin and extending along a portion of the stem through hole.

13. The slide pin holder assembly according to claim 12, wherein a ratio d/D of an outside diameter (d) of the slide pin to an inside diameter (D) of the stem through hole is approximately 1.36 to 1.40.

14. The slide pin holder assembly according to claim 12, wherein a ratio (h/d) of a distance h from a plane extending through said chamfered portion along the upper surface of the slide pin to an outside diameter (d) of the slide pin is approximately 0.73 to 0.82.

15. The slide pin holder assembly according to claim 13, wherein a ratio (h/d) of a distance h from a plane extending through said chamfered portion along the upper surface of the slide pin to the outside diameter (d) of the slide pin is approximately 0.73 to 0.82.

* * * * *